US005793271A

United States Patent [19]

Caceres Armendariz

[11] Patent Number: 5,793,271

[45] Date of Patent: Aug. 11, 1998

[54] DUAL-MODE CAVITY FILTER

[75] Inventor: José Luis Caceres Armendariz, Tres Cantos, Spain

[73] Assignee: Alcatel Alsthom Compagnie Générale d'Electricité, Paris, France

[21] Appl. No.: 769,614

[22] Filed: Dec. 18, 1996

[30] Foreign Application Priority Data

Dec. 29, 1995 [ES] Spain ..... 9502560

[51] Int. Cl.[6] ..... H01P 1/208

[52] U.S. Cl. ..... 333/209; 333/212

[58] Field of Search ..... 333/202, 208–212, 333/227, 230–232

[56] References Cited

U.S. PATENT DOCUMENTS

| | | | |
|---|---|---|---|
| 2,890,421 | 6/1959 | Currie | 333/209 X |
| 4,513,264 | 4/1985 | Dorey et al. | 333/209 X |
| 4,544,901 | 10/1985 | Rhodes et al. | 333/208 X |
| 5,349,316 | 9/1994 | Sterns | 333/212 X |

FOREIGN PATENT DOCUMENTS

| | | | |
|---|---|---|---|
| 2557809 | 6/1977 | Germany . | |
| 63-65701 | 3/1988 | Japan | 333/212 |

OTHER PUBLICATIONS

"Realization of Dual-Mode Longitudinal Filters with Arbitrary Polarization of Input and Output Ports", p. 253, 1986 IEEE-MIT-S International Microwave Symposium-Digest, 2–4 Jun. 1986, Baltimore (US), pp. 253–256 by J. Frenna.

Patent Abstracts of Japan, vol. 6, No. 259 (E-149) [1137], 17 Dec. 1982 & JP 57 155802 A (Nippon Denki K.K.), 27 Sep. 1982.

Journees Nationales Microondes (JNM), Nice, Jun. 22–24, 1987, No. vol. 5, 22. Jun. 1987, Givelet J. "Conception de Filtres Microondes A Cavites Bimodes Ayant Une Reponse En Amplitude Dissymetrique", pp. 44–45, 46.

"A Full-Wave Analysis of Tuning and Coupling Posts in Dual-Mode Circular Waveguide Filters" J. Montejo-Garai, et al. Microwave and Optical Tech. pp. 505–507, vol. 7 Aug. 11, 1994.

*Primary Examiner*—Seungsook Ham

*Attorney, Agent, or Firm*—Ware, Fressola, Van Der Sluys & Adolphson LLP

[57] ABSTRACT

Comprising one or more resonant cavities in which are produced two resonant modes at two different frequencies $f_1$ and $f_2$, both modes having essentially the same field distributions but rotated 90° with respect to each other. Each cavity comprises a tuning element ($TS_a$) for tuning the resonant frequency $f_1$ of the first mode along a first axis, a tuning element ($TS_b$) for tuning the resonant frequency $f_2$ of the second mode along a second axis perpendicular to the first, input coupling means (IC) and output coupling means (OC) for injecting into and extracting from the cavity, respectively, a radiofrequency signal along axes not parallel to those of resonance. Filter tuning is done by using only two tuning elements, which means that the filter cost is lower and the tuning time is reduced.

2 Claims, 1 Drawing Sheet

DUAL-MODE CAVITY FILTER

TECHNICAL FIELD

This invention is directed to a dual-mode cavity filter excited by two orthogonal propagation modes with similar field distributions and in which the modes mentioned are tuned independently of each other.

This type of filter has a particular application in microwave technology with complex transfer functions since it permits, for a single transfer function, the use of half the number of cavities that would be required with a filter not of the dual-mode type. The result is a filter of much lower weight and volume and therefore highly attractive for space applications.

The invention described below is intended for the design of this kind of filter which permits its production at lower cost and the time required for tuning adjustments to be reduced, the latter being achieved through the simplification of the tuning elements that it incorporates.

BACKGROUND OF THE INVENTION

To date, dual-mode cavity filters have, in the majority of cases, been based on the use of resonant structures and resonant modes whose field distributions permit excitation on two perpendicular axes of polarization. The cavity is then excited at one of the two resonant frequencies (or at both simultaneously) such that the frequencies at which the cavity resonates are tuned and the fields inside it are mutually coupled.

By means of a coupling window, a portion of the resonant energy on one of the axes (or on both) is extracted.

Independently of the means of coupling employed for injecting and extracting the cavity input and output signals, tuning is always done inside the cavity by means of three tuning screws or equivalent devices.

This is explained in the article "A full-wave analysis of tuning and coupling posts in dual-mode circular waveguide filters" by J. Montejo-Garai et al., published in Microwave and Optical Technology Letters, vol. 7, n° 11, of Aug. 5th, 1994, pages 505 to 507.

The publication mentioned shows how a first tuning screw can be employed to tune the first resonant mode in accordance with the field direction in one of the modes of propagation; a second screw is used to tune the second resonant mode according to the field direction in the other mode of propagation; and finally a third tuning screw is used to produce the mutual coupling between the two modes.

The use of this third tuning screw consequently results in the two orthogonal modes not being independent. Despite this, it is assumed that there are still three degrees of freedom for effecting the tuning and that they are normally associated with the three parameters of the equivalent circuit model employed in the analysis and design of this type of filters. These parameters are the resonant frequencies of each of the modes and the mutual coupling between the two of them.

By means of the tuning elements both modes in each cavity can be tuned to the design centre frequency "$f_0$" and the desired coupling value "k" obtained.

The elimination of one or more tuning screws can only be justified when a very precise design of the cavity dimensions is made, whereby there is no requirement for any adjustment.

For this to be possible, it is necessary to have an extremely costly manufacturing process that permits tight control of mechanical tolerances; consequently it is only admissible in prototypes. The inclusion of tuning elements, normally screws, appears therefore to be unavoidable although it increases the cost of the filters both in their manufacture and in the adjustment time needed for their tuning.

SUMMARY OF THE INVENTION

The cavity filter of this invention comprises one or more dual-mode resonant cavities in which in each cavity two resonant modes are produced at two different frequencies $f_1$ and $f_2$, both modes having essentially the same field distribution but rotated 90° one from the other and in which each cavity includes first tuning elements for tuning resonant frequency $f_1$ of the first resonant mode along a first axis, second tuning elements for tuning resonant frequency $f_2$ of the second resonant mode along a second axis perpendicular to the first, input coupling means for injecting a radiofrequency signal into the cavity in accordance with the field polarizations along axes not parallel to those of resonance, and output coupling means for extracting the applied signal from the cavity in accordance with the field polarizations in accordance with the axes not parallel to those of resonance.

Thus, the filter tuning is achieved through the use of only two tuning elements, which results in a lower filter material cost and the use of less time to carry out its tuning.

BRIEF DESCRIPTION OF THE FIGURES

A fuller explanation of the invention is provided in the following description of it, based on the figures attached, in which.

BEST MODE FOR CARRYING OUT THE INVENTION

A cavity filter of this type is formed by a number of resonant cavities arranged one after the other and coupled through rectangular windows cut in the conductor that separates them.

Below is given a description of a filter of this type in which, for greater simplicity, only one cylindrical type cavity has been used, the model being perfectly applicable to a greater number of cavities.

This cavity is of a size that permits two modes of propagation along two axes of polarization $E_a$ and $E_b$ perpendicular to each other. These axes of polarization are fixed by the actual geometry of the cavity and by the tuning elements.

The cavity also has input coupling means IC and output coupling means OC which are windows or slots made in the faces perpendicular to the direction of propagation. These windows permit, respectively, the excitation of the cavity by means of an input signal the direction of polarization of which is rotated a certain angle $\alpha$ with respect to that of the propagation modes inside the cavity, and the extraction of the signal from the cavity in a direction of polarization also rotated 90° with respect to that of the excitation.

Figure 1:
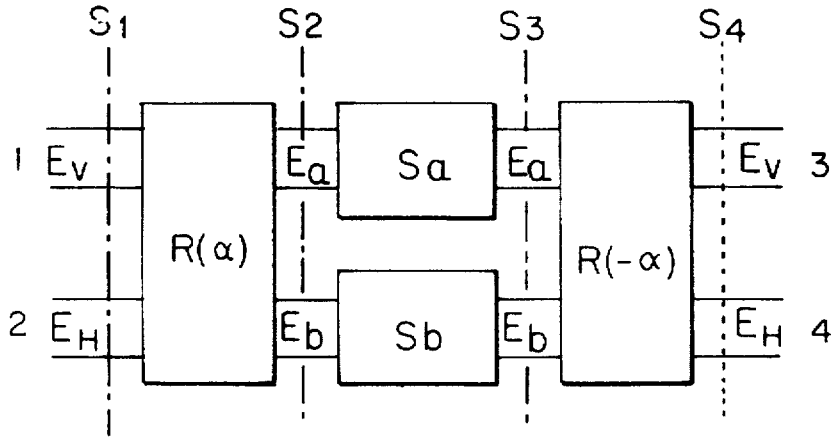
FIG. 1 is a drawing of the equivalent circuit of a cavity designed to have two orthogonal modes of resonance.

FIG. 1 shows the equivalent circuit of the cavity described. The behaviour of the modes of propagation a and b within the cavity, between its input and output planes S2 and S3, can be modeled, respectively, using an uncoupled two-port network.

Between the input and output planes of the 4-port network, S1 and S2, each field is proportional to a certain standardised field pattern, Ea and Eb, defined by the modes of propagation. Any field in the input and output planes, S1 and S2, can be expressed as a linear combination of the aforementioned standardised fields $E_a$ and $E_b$. This type of breakdown is applicable to the incident and reflected waves at all the ports.

Referring now to the exciting and extracting signal fields, $E_v$ and $E_H$, the following relationship can be found:

$$\begin{pmatrix} E_V \\ E_H \end{pmatrix} = \begin{pmatrix} \cos\alpha & \operatorname{sen}\alpha \\ -\operatorname{sen}\alpha & \cos\alpha \end{pmatrix} \begin{pmatrix} E_a \\ E_b \end{pmatrix} = R(\alpha) \begin{pmatrix} E_a \\ E_b \end{pmatrix}$$

in which $\alpha$ represents the angle of rotation between the two directions of polarization, that of the input and output signals and that of the propagation modes inside the cavity.

This transformation relates the excitation patterns $E_H$ and $E_v$ with the patterns of the resonant fields $E_a$ and $E_b$. The four-port network of FIG. 1 is determined, in terms of the S parameters, for the incident and reflected waves by the following expression:

$$(S) = \left(\begin{array}{c|c} R(\alpha) & 0 \\ \hline 0 & R(\alpha) \end{array}\right) \begin{pmatrix} Sa_{11} & 0 & Sa_{12} & 0 \\ 0 & Sb_{11} & 0 & Sb_{12} \\ Sa_{21} & 0 & Sa_{22} & 0 \\ 0 & Sb_{21} & 0 & Sb_{22} \end{pmatrix} \left(\begin{array}{c|c} R^T(\alpha) & 0 \\ \hline 0 & R^T(\alpha) \end{array}\right)$$

in which $Sa_{ij}$ and $Sb_{ij}$ are the S parameters of the two individual modes of propagation and $R(\alpha)$ is the rotation vector matrix.

Dual-mode operation of the four-port network happens when a signal is transmitted from one of the inputs 1,2 to both outputs 3 and 4.

By developing the last expression, it can be shown that this occurs when $\sin\alpha \cos\alpha(Sb_{12}-Sa_{12})\neq 0$. For this to happen, two conditions have to be satisfied:

1. the angle of rotation $\alpha$ has to be different from $n\pi/2$, and
2. the parameters $Sb_{12}$, $Sa_{12}$ have to be different ($Sb_{12}\neq Sa_{12}$). This condition implies that the electrical lengths of the two modes of propagation are different.

Figure 2:
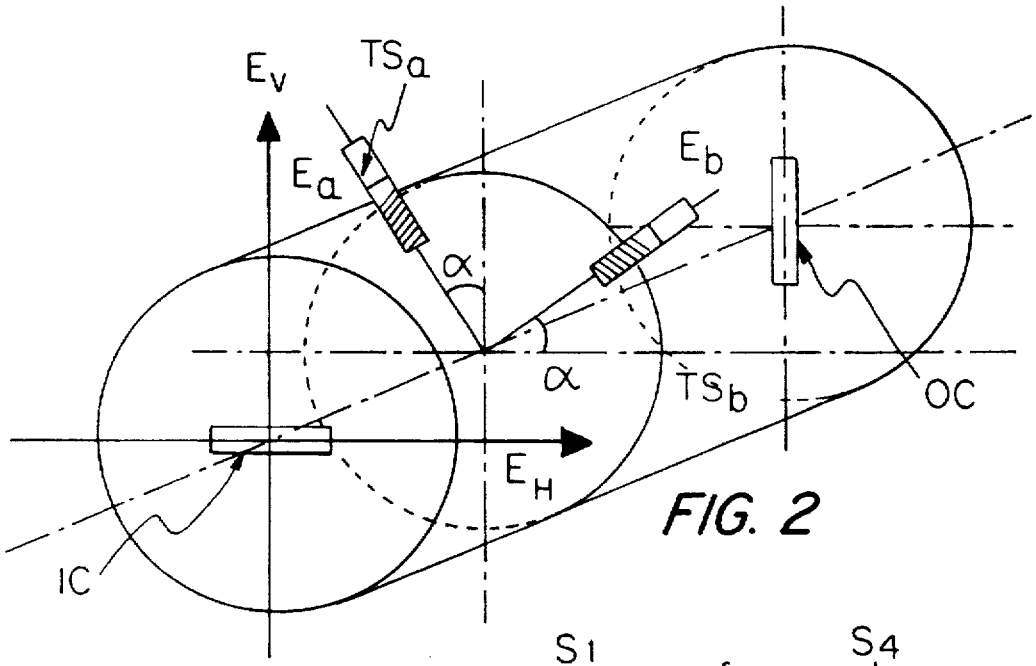
FIG. 2 shows a cylindrical cavity with two orthogonal modes of propagation, which includes two tuning screws in a direction rotated an angle $\alpha$ with respect to the fields that are propagated.

In other words, the cavity of FIG. 2 offers dual-mode resonance if both modes are excited simultaneously and their resonances are tuned to different frequencies $f_1$ and $f_2$.

As can be seen from FIG. 2, the angle of rotation $\alpha$ between the axes of polarization of the input and output signals and the axes of the polarization of the cavity is 45° and the polarizations in the cavity are forced by means of two small protuberances that are the actual tuning elements $TS_a$ and $TS_b$ which are introduced into the cavity along two mutually perpendicular axes.

The matrix of the vector of rotation $R(\alpha)$ therefore becomes:

$$\frac{1}{\sqrt{2}} \begin{pmatrix} 1 & 1 \\ -1 & 1 \end{pmatrix}$$

By expanding the S parameters of the two modes in the four-port network, the following expression is found:

$$(S) = \begin{pmatrix} 0 & 0 & S_{13} & S_{14} \\ 0 & 0 & S_{14} & S_{13} \\ S_{13} & S_{14} & 0 & 0 \\ S_{14} & S_{13} & 0 & 0 \end{pmatrix}$$

in which $S_{13}=\frac{1}{2}(e^{-j\upsilon_a}+e^{-j\upsilon_b})$ and $S_{14}=\frac{1}{2}(e^{-j\upsilon_b}-e^{-j\upsilon_a})$.

By assuming that the effect of the tuning elements $TS_a$ and $TS_b$ is an effective increase of the electrical length of the cavity, it is possible to make $\upsilon_a\neq\upsilon_b$.

Figure 3:
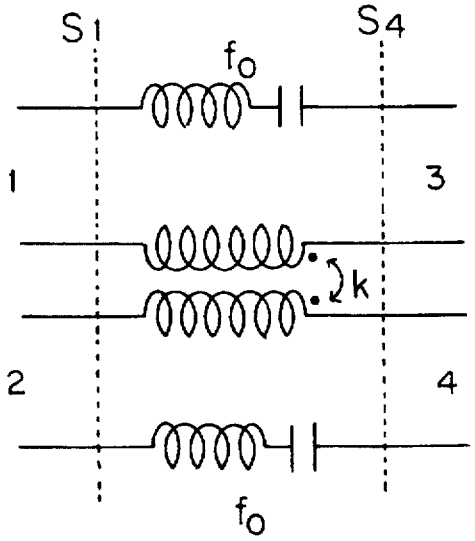
FIG. 3 shows the narrow-band equivalent circuit commonly employed for the design of this type of filter.

In a narrow-band approximation, the dual mode cavity can be associated with the equivalent circuit of FIG. 3, commonly employed in filter synthesis, in which $f_0$ is the frequency of series resonance of the upper and lower branches and k is the coupling coefficient between the two modes.

By identifying the S parameters of both networks close to $f_0$, the following approximations are obtained:

$$f_o \approx 2\frac{f_1 * f_2}{f_1+f_2} \text{ and } k \approx 2\frac{f_2-f_1}{f_1+f_2}\ (-1)^n \text{ when } |f_2-f_1| \ll (f_1+f_2)/n\pi$$

This shows that the dual-mode cavity described above can be employed for designing and tuning a filter by correcting the electrical dimensions by modifying the effective length of the cavity by a whole multiple of one half-wavelength at the resonant frequency $f_0$ and by acting on the tuning elements $TS_a$ and $TS_b$ to achieve the resonant frequencies $f_1$ and $f_2$ of each of the modes a and b in accordance with the desired values of $f_0$ and k of the synthesis network.

What is claimed is:

1. A dual-mode cavity filter comprising one or more dual-mode resonant cavities in which in each cavity two resonant modes are produced at two different frequencies $f_1$ and $f_2$, both modes having essentially the same field distributions but rotated 90° with respect to each other, characterized in that each cavity comprises:

first tuning elements ($TS_a$) to tune the resonant frequency $f_1$ of a first resonant mode along a first axis, second tuning elements ($TS_b$) to tune the resonant frequency $f_2$ of a second resonant mode along a second axis perpendicular to the first, input slot coupling means (IC) to inject a radio frequency signal into the cavity along an axis not parallel to the first and second axes of the resonant frequencies $f_1$ and $f_2$, and output slot means (OC) to extract the applied signal from the cavity along an axis not parallel to the first and second axes of the resonant frequencies $f_1$ and $f_2$, and perpendicular to the axis along which the radio frequency signal is injected into the cavity.

2. A dual-mode cavity filter in accordance with claim 1 characterized in that the first and second axes of the resonant modes are rotated 45° with respect to the axes of the input and output slot couplings.

* * * * *